US007862133B2

(12) United States Patent
Kitakami et al.

(10) Patent No.: US 7,862,133 B2
(45) Date of Patent: Jan. 4, 2011

(54) LIQUID DISCHARGING METHOD AND LIQUID DISCHARGING APPARATUS

(75) Inventors: Koichi Kitakami, Chigasaki (JP); Toshiharu Sumiya, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 524 days.

(21) Appl. No.: 11/957,933

(22) Filed: Dec. 17, 2007

(65) Prior Publication Data

US 2008/0291236 A1 Nov. 27, 2008

(30) Foreign Application Priority Data

Jan. 12, 2007 (JP) ..... 2007-004440

(51) Int. Cl.
*B41J 29/38* (2006.01)

(52) U.S. Cl. ..... 347/9

(58) Field of Classification Search ..... 347/9, 347/10, 30

See application file for complete search history.

(56) References Cited

U.S. PATENT DOCUMENTS 5,453,767 A 9/1995 Chang et al.
7,419,235 B2 * 9/2008 Kitakami ..... 347/14
2005/0156977 A1 7/2005 Kitakami

FOREIGN PATENT DOCUMENTS

| | | |
|---|---|---|
| EP | 0 531 173 | 3/1993 |
| JP | 5-057888 | 3/1993 |
| JP | 7-076087 | 3/1995 |
| JP | 9-141851 | 6/1997 |
| JP | 10-193587 | 7/1998 |

* cited by examiner

*Primary Examiner*—An H Do
(74) *Attorney, Agent, or Firm*—Fitzpatrick, Cella, Harper & Scinto

(57) ABSTRACT

A liquid discharging head is appropriately driven to effectively prevent a satellite from being generated irrespective of conditions such as a property of a discharge liquid or a head structure. The liquid discharging head is driven using volume variation in a manner that a liquid extending in a column shape at the time of separating a liquid droplet (main droplet) is gradually thickened from the separation portion to a discharge port, and that the liquid protrudes from the discharge port during a period where the length of the liquid extending in the column shape is shortened after the droplet is separated. Accordingly, it is possible to effectively prevent a liquid column from further being separated after the main droplet is separated, and to restrict the satellite from being generated, irrespective of conditions such as the property of the discharge liquid or the head structure.

3 Claims, 7 Drawing Sheets

FIG. 6
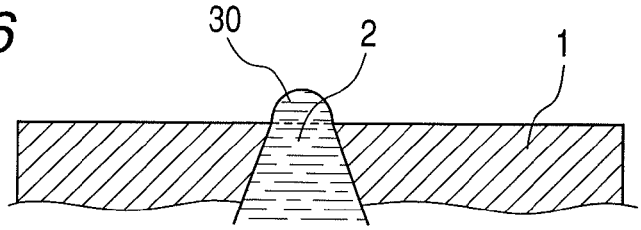
FIG. 7A 18μs
FIG. 7B 20μs
FIG. 7C 22μs
FIG. 7D 24μs
FIG. 7E 26μs
FIG. 7F 28μs
FIG. 7G 30μs
FIG. 7H 32μs
FIG. 7I 34μs
FIG. 7J 36μs
FIG. 7K 38μs
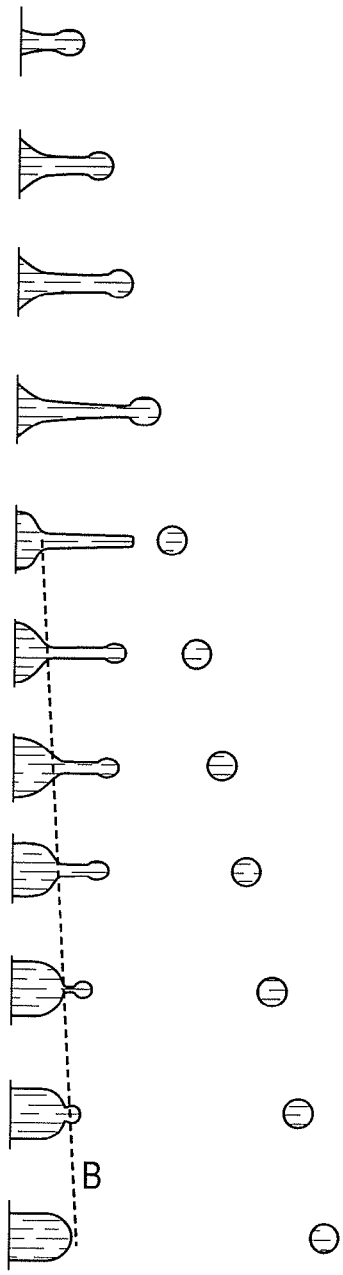

FIG. 11A 18μs
FIG. 11B 20μs
FIG. 11C 22μs
FIG. 11D 24μs
FIG. 11E 26μs
FIG. 11F 28μs
FIG. 11G 30μs
FIG. 11H 32μs
FIG. 11I 34μs
FIG. 11J 36μs
FIG. 11K 38μs
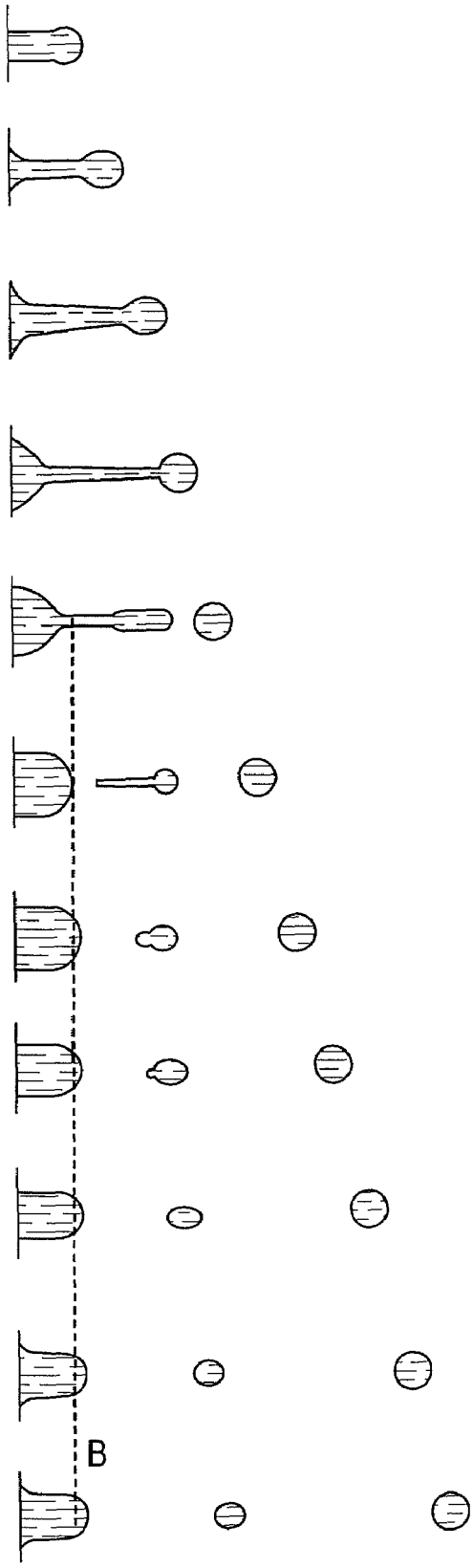

LIQUID DISCHARGING METHOD AND LIQUID DISCHARGING APPARATUS

BACKGROUND OF THE INVENTION

1. Field of the Invention

The present invention relates to a liquid discharging method and a liquid discharging apparatus and particularly those using a liquid discharging head including a discharge port for discharging a liquid and an individual liquid chamber which communicates with the discharge port and discharges the liquid from the discharge port according to volume variation. The invention is applicable to an apparatus for performing a recording operation on a recording medium such as a paper sheet, cloth, leather, non-woven, or an OHP plastic film, an apparatus for performing a patterning or processing operation on a medium (receptor) such as a substrate, plate material, or a solid material by attaching the liquid thereto, and a coating apparatus.

2. Description of the Related Art

There is a known liquid discharging head in which a diaphragm contacting a liquid in an individual liquid chamber is provided, the diaphragm is displaced by a piezoelectric film which is deformed according to application of a voltage, and then the volume of the individual liquid chamber is increased or decreased so as to eject an ink by a change of pressure caused thereby.

In such a liquid discharging head having the above-described configuration, the discharged liquid extends in a column shape and separates halfway. Accordingly, a separated liquid droplet reaches a liquid receptor such as a recording medium. At this time, a subsidiary liquid droplet called a satellite may be generated, in addition to the intended liquid droplet (main droplet) to reach the receptor. Generally, the satellite is smaller than the main droplet, and the speed of the satellite is slower than that of the main droplet. Accordingly, the satellite may be deposited at a position deviated from the main droplet in the liquid receptor such as the recording medium, which may cause deterioration of recording quality and patterning precision. Additionally, the satellite may float in the form of a mist, and may be attached to an discharge port formation surface of the liquid discharging head, by which a direction of the liquid to be subsequently discharged may be diffracted or attached to the inside of the apparatus, which may cause contamination of the apparatus.

In order to solve such a problem, in the past, there have been proposed various technologies of preventing the satellite from being generated.

For example, Japanese Patent Application Laid-Open No. H05-057888 (EP A1 0531173) discloses a method for restricting the satellite from being generated in the configuration including a piezoelectric element which is deformed according to application of a voltage so as to increase or decrease the volume of the individual liquid chamber (ink chamber). In such a method, in order to decrease the volume of the individual liquid chamber, a braking pulse is instantaneously applied to the piezoelectric element after a driving voltage to the piezoelectric element has reached a peak level so that inertia of both the piezoelectric element and the ink contained in the ink chamber is immediately canceled to abruptly stop the ink discharge. A driving voltage waveform shown in FIG. 1A of Japanese Patent Application Laid-Open No. H05-057888 (EP A1 0531173) has an abrupt region.

Additionally, a method of driving a piezoelectric vibrator is disclosed in Japanese Patent Application Laid-Open No. H07-076087 (U.S. Pat. No. 5,453,767). In such a method, the piezoelectric vibrator is driven so that the volume of the individual liquid chamber is increased, the volume is decreased at a first changing speed, and the volume is decreased at a second changing speed faster than the first changing speed. Accordingly, a speed difference between the front end and the rear end of the liquid column (ink column) is decreased to thereby form a spherical ink droplet.

In the method disclosed in Japanese Patent Application Laid-Open No. H05-057888 (EP A1 0531173), the braking pulse is instantaneously applied to the piezoelectric element after the driving voltage to the piezoelectric element has reached the peak level. As shown in FIG. 1A, it is appropriate to consider that the braking pulse is instantaneously applied to the piezoelectric element at the time of reaching the peak level. However, there is no detailed description about how the peak level is set and how the abrupt gradient of each region of the driving voltage waveform is estimated. Additionally, the ink discharging operation at the time of application of the driving voltage having such a waveform is not described in detail with reference to the drawings. Specifically, it is not clear how the satellite is prevented from being generated.

Meanwhile, in the method disclosed in Japanese Patent Application Laid-Open No. H07-076087 (U.S. Pat. No. 5,453,767), the speed difference between the front end and the rear end of the ink droplet is decreased compared with a conventional example, but the speed of the front end is still faster than that of the rear end. Accordingly, it can be easily expected that a plurality of satellites are generated based on the ratio between the thickness and the length of the liquid column shown in FIG. 7VIII of Japanese Patent Application Laid-Open No. H07-076087 (U.S. Pat. No. 5,453,767).

SUMMARY OF THE INVENTION

The inventors have carefully studied and found a case where a satellite is not generated even when a voltage waveform, as shown in FIG. 10 in the specification, having a plurality of holding regions (which are waveform regions holding a predetermined voltage), that is, a driving voltage waveform without an abrupt braking pulse, is input. In the method disclosed in Japanese Patent Application Laid-Open No. H05-057888 (EP A1 0531173), a gradient of each region of the driving voltage waveform is not described in detail. Also, it is not clear how the abrupt gradient of each region of the driving voltage waveform is estimated. In contrast, the voltage waveform found by the inventors is not the abrupt voltage waveform in that the holding region is included therein, as generally understood. That is, a more general mechanism for preventing the satellite from being generated needs to be studied in different view points.

An object of the invention is to drive appropriately a liquid discharging head so as to prevent effectively the satellite from being generated based on a general guideline. In this case, the liquid discharging head may be applied to various fields such as not only a recording apparatus, but also a patterning apparatus and a coating apparatus which use a liquid of various properties and various head structures. Accordingly, the invention may extend an application scope by providing an appropriate and general guideline for the drive control of the liquid discharging head.

According to an aspect of the invention, there is provided a liquid discharging method of discharging a liquid as a liquid droplet from a discharge port by driving a volume control means for increasing or decreasing a volume of a liquid chamber which communicates with the discharge port, the method including: driving the volume control means to allow the liquid extending in a column shape to be gradually thickened toward the discharge port immediately after a substantially spherical liquid connected to the front end of the liquid extending in the column shape from the discharge port separates from the liquid extending in the column shape; and retracting the liquid extending in the column shape to the discharge port by protruding the liquid to the outside from the discharge port after the liquid droplet is formed by separating the substantially spherical liquid from the liquid extending in the column shape.

According to another aspect of the invention, there is provided a liquid discharging apparatus including: a liquid discharging head which has a discharge port for discharging a liquid, a liquid chamber which communicates with the discharge port, and a volume control means for increasing or decreasing the volume of the liquid chamber; and a drive means which drives the volume control means, wherein the drive means drives the volume control means so that a liquid extending in a column shape is gradually thickened toward the discharge port immediately after a substantially spherical liquid connected to the front end of the liquid extending in the column shape from the discharge port separates from the liquid extending in the column shape, and the liquid extending in the column shape is retracted to the discharge port by protruding the liquid to the outside from the discharge port after forming the liquid droplet by separating the substantially spherical liquid from the liquid extending in the column shape.

In liquid discharging apparatus having the above-described configuration, the liquid discharging head is driven according to the volume variation so that the liquid column before and after separating the liquid droplet (main droplet) is gradually thickened toward the discharge port, and the liquid protrudes from the discharge port after separating the liquid droplet. Accordingly, it is possible to effectively prevent the liquid column from further being separated after the main droplet separation and to restrict the satellite from being generated.

Further features of the present invention will become apparent from the following description of exemplary embodiments with reference to the attached drawings.

BRIEF DESCRIPTION OF THE DRAWINGS

FIG. 6 is a schematic view illustrating a protruding state of a meniscus after a liquid discharge.

FIGS. 7A, 7B, 7C, 7D, 7E, 7F, 7G, 7H, 7I, 7J and 7K are views illustrating a liquid discharge shape according to Example 1.

FIGS. 11A, 11B, 11C, 11D, 11E, 11F, 11G, 11H, 11I, 11J and 11K are views illustrating a liquid discharge state according to Comparative Example 1 compared with Example 1.

DESCRIPTION OF THE EMBODIMENTS

Hereinafter, the invention will be described with reference to the drawings.

1. Basic Concept of the Invention

Based on the various experiments and examination which are described above, the inventors considered that a general mechanism needs to be studied in different view points instead of just selecting a driving voltage waveform under a limited condition at the time of determining a general guideline for restricting a satellite from being generated.

In a piezoelectric element as a mechanical drive source for generating an increase or decrease in the volume of an individual liquid chamber, there is a region where a displacement amount is substantially proportional to an input voltage. However, first the inventors focused on the fact that a known liquid discharging method is realized based on the factor.

Figure 3:
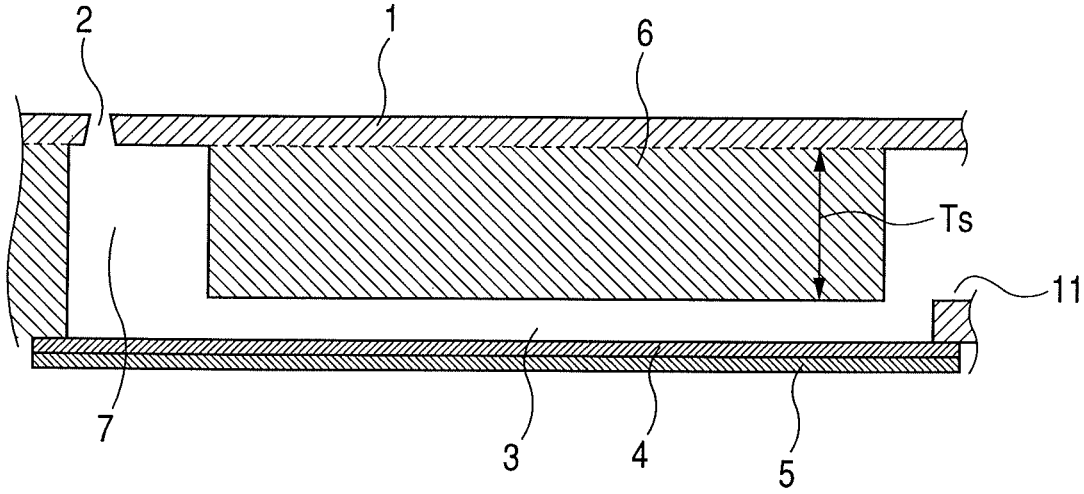
FIG. 3 is a sectional view taken along the line 3-3 shown in FIG. 2 and illustrating a configuration example of the liquid discharging head to which the invention is applicable.
Figure 4:
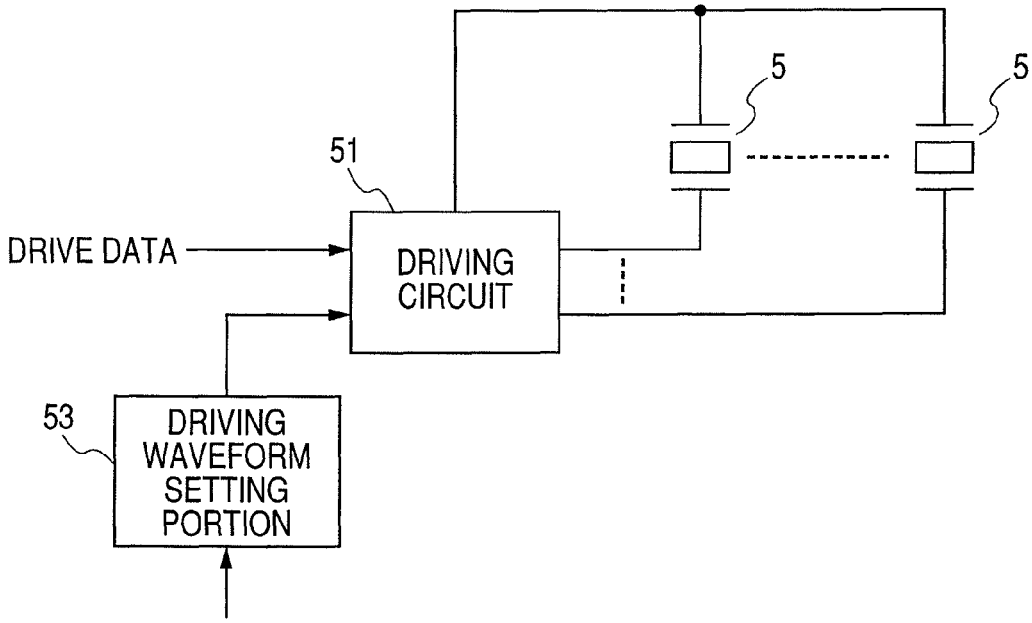
FIG. 4 is a block diagram illustrating a configuration example of a drive means of an actuator (piezoelectric element).

However, in Japanese Patent Application Laid-Open No. H09-141851, FIG. 3 shows that the displacement of the actuator as a mechanical drive source does not return to zero even when a driving voltage returns to zero. Similarly, FIG. 4 shows that the displacement of the actuator becomes larger in the subsequent application of the voltage having the driving voltage waveform with a step shape in which an absolute value of voltage is small than in the preceding application of the voltage having the driving voltage waveform with a pulse shape in which an absolute value of voltage is large.

That is, in the piezoelectric element, when the voltage is applied statically or the voltage is gradually varied with a time axis to some extent, the displacement amount is substantially proportional to the applied voltage. However, in the case where the driving voltage having a waveform which varies within a time of several tens of μs is applied to eject the liquid, as shown in Japanese Patent Application Laid-Open No. H09-141851, there is no relation between the voltage waveform and the displacement amount.

As described above, in the liquid discharging head using a deformation and a bend of the piezoelectric element, the voltage variation does not directly coincide with the displacement variation of the actuator or the diaphragm. Even when the voltage is maintained constantly, the displacement of the diaphragm may occur depending on how the voltage has changed before. For this reason, it is difficult and extremely insufficient to obtain a direct and general condition or causation for preventing the satellite from being generated just by studying the shape of the driving voltage waveform.

A movement of the liquid is caused by an increase or decrease in the volume of the individual liquid chamber according to an input driving voltage waveform. However, a response characteristic of the increase or decrease in the volume to the input driving voltage waveform is different depending on conditions such as a property of the liquid which actually remains in the individual liquid chamber or a head structure. Accordingly, even when the driving voltage waveform is set under limited conditions, the driving voltage waveform cannot be a general solving method for controlling discharge performance (an amount of discharge liquid and a speed of discharge liquid) of the liquid and a movement (a formation of a liquid column, a liquid droplet separation, and an advancing or retreating action of a meniscus in the vicinity of an discharge port) of the liquid.

On the contrary, when the volume of the individual liquid chamber increases, the liquid in the vicinity of the discharge port is necessarily sucked to the inside thereof. Alternatively, when the volume of the individual liquid chamber decreases, the liquid in the vicinity of the discharge port is necessarily pushed to the outside thereof.

For this reason, the inventors thought that an index for controlling the discharge performance or the movement of the liquid is not the driving voltage waveform of the piezoelectric element, that is, time transition of the driving voltage, but the transition of the increase or decrease in the volume of the individual liquid chamber. In fact, the increase or decrease in the volume of the individual liquid chamber is caused by a displacement of a unit (diaphragm) which is disposed in each individual liquid chamber and moves in response to a deformation or a bend of the piezoelectric element. Accordingly, specifically, the time transition $\delta(t)$ of the displacement of the diaphragm inducing the increase or decrease in the volume of the individual liquid chamber can be used as the index for obtaining the desirable discharge performance and the desirable movement of the liquid.

In brief, the satellite is generated in a manner that a liquid column with a predetermined length is cut in a plurality of positions and the cut liquid columns become round due to a surface tension. For this reason, a desirable movement of the liquid is a direct and general condition for preventing the satellite. Accordingly, the driving voltage waveform of the piezoelectric element may well be selected so as to cause the time transition (i.e. time transition of an out-of-plane displacement of the diaphragm) of the increase and decrease in the volume in the individual liquid chamber which induces the desirable movement of the liquid.

In the invention, at the time point where the first liquid column separation, that is, main liquid droplet separation occurs, a liquid column which is thickened from the separated position toward a root is formed. Additionally, during a period when the length of the liquid extending in a column shape is shortened from the time point, the liquid is moved to protrude the meniscus. By forming the liquid column which is thickened toward the root, the liquid column separation, that is, a generation of the satellite hardly occurs after the main liquid droplet is separated. Subsequently, the liquid column is immediately absorbed by the protruding meniscus, and thus the further liquid column separation is effectively restricted.

Additionally, in the embodiment which will be described below, the liquid droplet is discharged by driving the actuator to increase and decrease the volume of the individual liquid chamber, and to increase and decrease the volume thereof again.

2. Embodiment of Liquid Discharging Apparatus and Liquid Discharging Head

Figure 1:
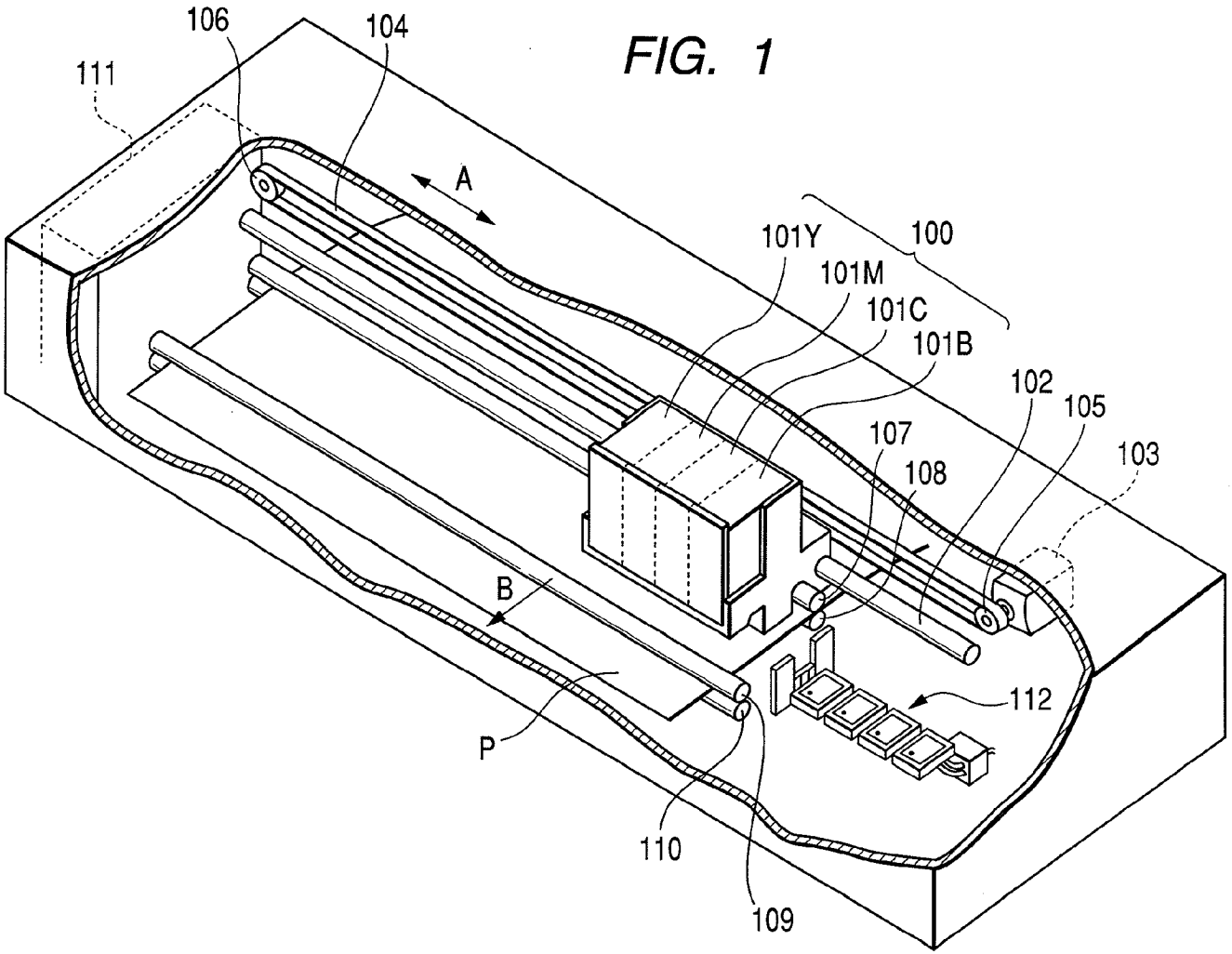
FIG. 1 is a schematic perspective view illustrating an ink jet recording apparatus which is an example of a liquid discharging apparatus to which the invention is applicable.

FIG. 1 is a schematic perspective view illustrating an ink jet recording apparatus, which is an example of a liquid discharging apparatus to which the invention is applicable. A recording medium P inserted in the liquid discharging apparatus is fed to a recordable area of a liquid discharging head unit 100 by feeding rollers 107, 108, 109, and 110. The liquid discharging head unit 100 is supported by a guide shaft 102 so as to move in its extending direction (main scanning direction). When a belt 104 suspended on pulleys 105 and 106 is moved by driving a motor 103, the liquid discharging head unit 100 reciprocates and scans the recording area. A scanning direction (A direction) of the liquid discharging head unit 100 corresponds to a main scanning direction, and a transporting direction (B direction) of the recording medium P corresponds to a sub scanning direction.

The liquid discharging head unit 100 is mounted with a liquid discharging head 103 for discharging ink droplets of a plurality of colors and an ink tank 101 for supplying ink to each liquid discharging head 103. In the exemplary liquid discharging apparatus, the plurality of colors of the ink include four colors of black (Bk), cyan (C), magenta (M), and yellow (Y). The arranged position of each color is not particularly limited. Additionally, the type and the number of color tones (color and concentration) are not limited.

In the exemplary ink discharging apparatus, each ink of the colors (Bk, C, M, and Y) of black, cyan, magenta, and yellow can be exchanged independently. The liquid discharging head unit 100 is mounted with a liquid discharging head group for discharging color liquid droplets of Bk, C, M and Y, an ink tank 101B for Bk, an ink tank 101C for C, an ink tank 101M for M, and an ink tank 101Y for Y. Each of the ink tanks is connected to the corresponding liquid discharging head and supplies the ink to an individual liquid chamber communicating with the discharge port of the liquid discharging head. Besides, for example, the ink tank for each color and the liquid discharging head may be formed as an incorporated member that cannot be separated. Further, in the state where only the liquid discharging head is mounted on the liquid discharging head unit, the ink may be supplied from the ink tank disposed on a fixed part of the apparatus through a flexible tube.

A recovery system unit 112 is disposed in the lower portion of one end (in the right end in the drawing) in the main scanning area where the liquid discharging head unit 100 can move. The recovery system unit 112 can include a cap for capping a discharge port formation surface of the liquid discharging head to protect the discharge port formation surface or to perform a sucking recovery during a non-recording operation. Alternatively, it can include a wiper blade for wiping out the discharge port formation surface.

Figure 2:
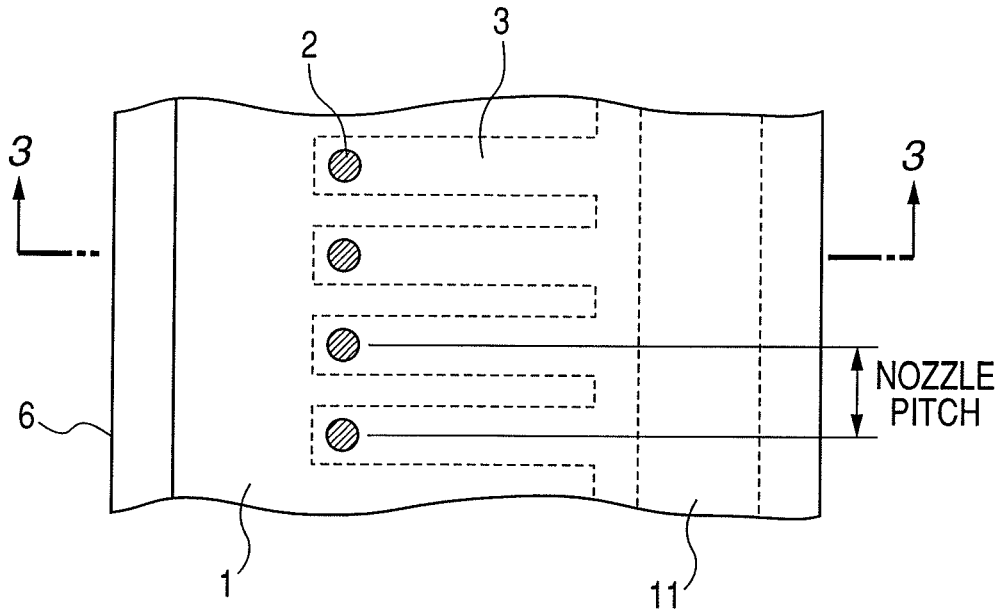
FIG. 2 is a schematic front view illustrating a configuration example of a liquid discharging head to which the invention is applicable when viewed from a discharge port formation side.

FIGS. 2 and 3 are views illustrating a configuration example of a liquid discharging head to which the invention is applicable, in which FIG. 2 is a schematic front view when viewed from the discharge port formation surface and FIG. 3 is a sectional view when taken along the line 3-3.

The exemplary liquid discharging head includes an orifice plate 1 in which a plurality of discharge ports 2 for discharging the ink are formed, and a substrate 6 including a wall portion for defining a common liquid chamber 11 supplying the ink and communicating with an individual liquid chamber 3 corresponding to each discharge port in a plurality of positions and a common position. The individual liquid chamber 3 communicates with the discharge port 2 through a communication passage 7. The substrate 6 has a thickness Ts.

A displaceable diaphragm 4 is disposed on a part of a side surface of the individual liquid chamber 3. An actuator 5 as a volume control means including a piezoelectric film and an electrode is disposed on the diaphragm 4. The diaphragm 4 is displaced by applying a driving voltage signal to the actuator 5 according to recording information. A liquid droplet can be discharged from the discharge port 2 by varying the volume in the individual liquid chamber 3. The actuator 5 is deformed in the thickness direction so as to increase (expand) the volume of the individual liquid chamber when the driving voltage applied thereto decreases and to decrease (contract) the volume of the individual liquid chamber when the driving voltage increases. That is, in the embodiment, the liquid discharging head controls the increase or decrease in the volume of the individual liquid chamber according to the displacement of the diaphragm fixed to the piezoelectric element in a direction perpendicular to the surface thereof by using the deformation of the piezoelectric element as the actuator.

In the liquid discharging head to which the invention is applicable, the length of the individual liquid chamber is in the range of 2,000 μm to 12,000 μm, and the diameter of the discharge port is in the range of 20 μm to 50 μm. Additionally, the thickness of the actuator 5, which includes an upper electrode, a piezoelectric film, and a lower electrode, may be 10 μm or less, and the thickness of the diaphragm 4 may be 10 μm or less in order to be easily deformable. More desirably, the thickness of the diaphragm is in the range of 3 μm to 6 μm. A thin film shape including the diaphragm and the actuator may be 10 μm or less. In such an actuator with the thin film shape, time transition δ(t) of the displacement of the diaphragm, which is an index for showing an increase or decrease in the volume of the individual liquid chamber, can be approximately used for a displacement (an out-of-plane displacement) of a surface (a position of the upper electrode) of the actuator 5. The displacement denotes a displacement in the direction perpendicular to the surface in which the diaphragm is formed, and can be measured by, for example, a Laser Doppler Velocimetry. A liquid discharge is appropriately carried out using the liquid discharging head so that the volume variation of the individual liquid chamber shown in FIG. 5 occurs by the displacement of the diaphragm which moves in response to the deformation, that is, bend of the piezoelectric film.

FIG. 4 is a view illustrating a configuration example of a drive means of the actuator 5. The actuator 5 is connected to a driving circuit 51 through an electrode wire for supplying an electric power. The driving circuit 51 can operate the actuator 5 using a driving voltage waveform determined by a driving waveform setting portion 53 based on a drive data (data for determining whether or not the discharge is performed) corresponding to the recorded information.

The driving waveform setting portion 53 sets a driving voltage waveform so as to cause time transition (time transition of an out-of-plane displacement of the diaphragm) of volume variation of the individual liquid chamber which induces a desirable movement of the liquid.

3. Example

Hereinafter, drive modes and effects of the liquid discharging head according to the invention will be described by way of a specific example and comparative examples.

3.1 Example 1

First, a liquid discharging head shown in FIGS. 2 and 3 was manufactured. At this time, a discharge port was configured as a round hole with a diameter of 30 μm, the length (a dimension in a horizontal direction in FIG. 3) of the individual liquid chamber 3 was set to 6,000 μm, and the width (a dimension in a direction perpendicular to the drawing in FIG. 3) thereof was set to 100 μm. In addition, the thickness of the actuator 5 was 3 μm and the thickness of the diaphragm 4 was 6 μm.

Additionally, the liquid discharging head increases or decreases the volume of the individual liquid chamber according to a displacement (the out-of-plane displacement) of the diaphragm fixed to the piezoelectric element in a direction perpendicular to the surface thereof using the deformation of the piezoelectric element as the actuator. In such a liquid discharging head, the volume (control liquid amount $V_{CON}$) of a flowing liquid at the time the diaphragm 4 displaces is determined based on the length of the individual liquid chamber, the width of the individual liquid chamber, and the time transition δ(t) of the displacement of the diaphragm. The control liquid amount $V_{CON}$ is substantially proportional to the product of the length of the individual liquid chamber, the width of the individual liquid chamber, and the time transition δ(t) of the displacement of the diaphragm. Accordingly, it is possible to obtain the same effect even when the length of the individual liquid chamber is halved and the width thereof becomes twice.

Figure 5:
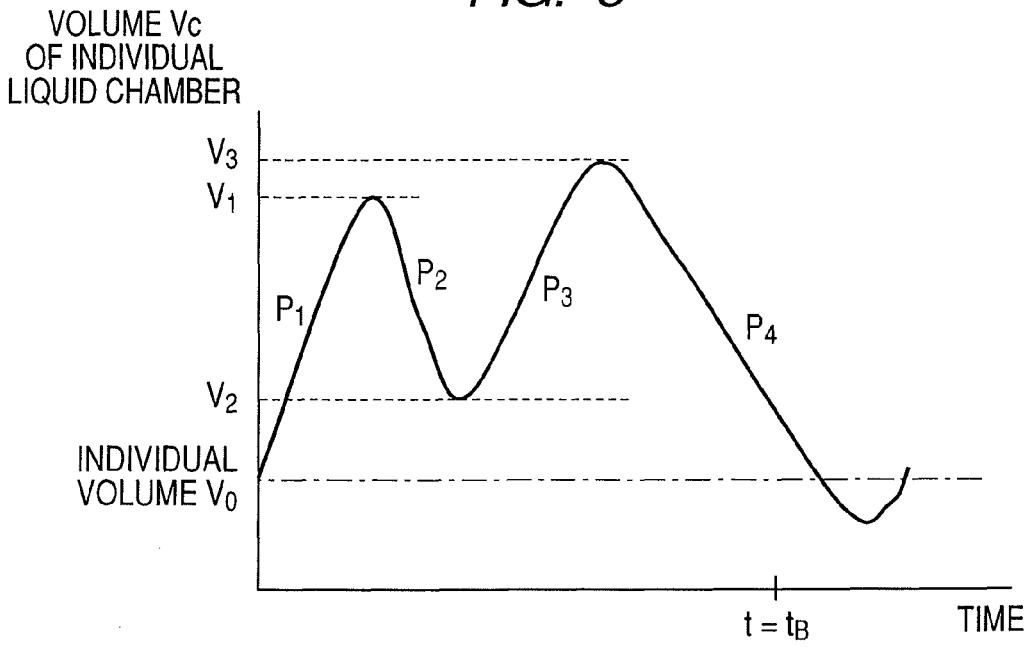
FIG. 5 is a view illustrating a variation curve of the volume of an individual liquid chamber according to Example 1 of the invention.

Next, a liquid was supplied to the liquid discharging head, and, as shown in FIG. 5, the volume of the individual liquid chamber 3 was varied to perform a discharging operation. At this time, a cyan ink having a density of $1.0\times10^3$ kg/m$^3$, a viscosity of $3.0\times10^{-3}$ Pa·s, and a surface tension of $3.5\times10^{-2}$ N/m was used as the liquid.

In the volume variation shown in FIG. 5, the next process was carried out. That is, first, a process $P_1$ was carried out so that the volume of the individual liquid chamber was increased from an initial volume $V_0$ (the initial state where the displacement of the diaphragm is zero at this time point) to a first volume $V_1$ (where a displacement amount was 95 nm at the time point t=9 μs). At this time, a meniscus was sucked to the inside of the discharge port 2.

Next, a process $P_2$ was carried out so that the volume thereof was decreased from the first volume $V_1$ to a second volume $V_2$ (where a displacement amount was 65 nm at the time point t=10 μs). At this time, the center portion of the sucked meniscus protruded and a liquid column was formed so as to extend in a discharge direction.

Next, a process $P_3$ was carried out so that the volume thereof was increased to a third volume $V_3$ (where a displacement amount was 100 nm at the time point t=12 μs, and relation of $V_3 \leqq V_1$ may be satisfied). At this time, the liquid column moved forward by inertia, but an outer peripheral portion of the meniscus was temporarily restricted from moving forward. Accordingly, the outer peripheral portion of the meniscus was prevented from being discharged, thereby forming the liquid droplet with desired volume.

Finally, a process $P_4$ was carried out so that the third volume $V_3$ was returned to the initial volume $V_0$ (where the volume of the individual liquid chamber 3 had a minute increase or decrease vibration factor due to an existence of a remaining vibration of various cycles and amplitudes, but the process $P_4$ was shown as a monotonous decreasing curve for convenience of description).

The liquid column separation, that is, the liquid droplet separation occurred at the time point $t_B$=25 μs in the process $P_4$, and at this time point, the liquid column was thickened toward its root. Additionally, from this time point, the liquid moved so that the meniscus protruded (overshot) from the discharge port.

As a result, in the discharged liquid droplet, an amount of discharge liquid was 1.8 pl and a speed of discharge liquid was 6.0 m/s, and the satellite was not generated. After the discharge, a meniscus 30 temporarily protruded to the discharge port as shown in FIG. 6, and then returned to a substantially flat state, which was an initial state.

The reason why the satellite is not generated in Example 1 will be studied based on an actual movement of the liquid.

Figure 8A:
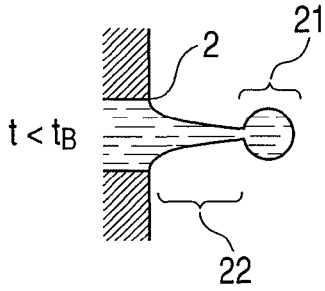
FIGS. 8A and 8B are views illustrating a liquid state immediately before and after a liquid column separation, that is, a liquid droplet separation.
Figure 8B:
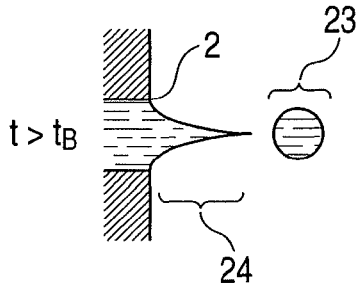

FIGS. 7A to 7K are views illustrating a liquid discharging state in the process $P_4$, and illustrates a liquid state from the start time point (FIG. 7A illustrates a state after 18 μs from the start time point of the process $P_1$) of the process $P_4$ at every interval of 2 μs. A CCD camera and a strobe light in synchronization with an ink discharge were used to obtain the measurement results. Additionally, FIGS. 8A and 8B are views illustrating a state immediately before and after the time point of the liquid column separation, that is, the liquid droplet separation.

In a liquid column 22 which includes a substantially spherical front end 21 to be immediately separated as the main liquid droplet while connecting the substantially spherical front end to the liquid in the discharge port 2, the part in the vicinity of the portion connected to the substantially spherical front end 21 is the thinnest and the liquid column 22 is gradually thickened toward the discharge port 2. FIGS. 7D and 8A illustrate this state.

As a result, at the time point $t=t_B$, it is possible to separate the liquid column by 100% only in the vicinity of the thinnest connection portion where the liquid column 22 is connected to the substantially spherical front end 21. Immediately after the time point $t=t_B$, in a liquid column portion 24 which was left after separating the liquid droplet (main liquid droplet 23) as shown in FIGS. 7E and 8B, the portion where the liquid droplet was separated was the thinnest, and the shape was gradually thickened toward the discharge port 2.

The thickness of the liquid column was partially identical. Alternatively, the liquid column became round due to a surface tension with time elapsed, so that the thinnest position of the liquid column slightly varied. However, the liquid column substantially maintained the shape in which the thickness was gradually increased toward the discharge port 2. As a result, a new liquid column separation did not occur in any position within the left liquid column portion 24. The length thereof was shortened by a surface tension (see FIGS. 7E to 7J).

Meanwhile, the displacement of the diaphragm was controlled so that the volume of the individual liquid chamber can be contracted continuously from the time point of the liquid separation time $t=t_B$ (=25 μs). That is, at the time point t=33 μs, the volume was decreased until the displacement amount became −10 nm, and thus the volume was more contracted than the initial volume. Accordingly, the meniscus protruded to the outside of the discharge port, and its protruding amount (the volume of the liquid protruding to the outside of the discharge port) was increased (see an auxiliary line B shown in FIGS. 7E to 7J). As a result, the root of the liquid column portion 24 can be maintained in a thick state, and the liquid column portion 24 immediately absorbed by the protruding meniscus. Therefore, it is possible to more effectively prevent a new liquid column separation from occurring.

Since the liquid moved as described above, the separation of the liquid column portion 24 did not occur and thus the satellite was not generated.

Figure 9A:
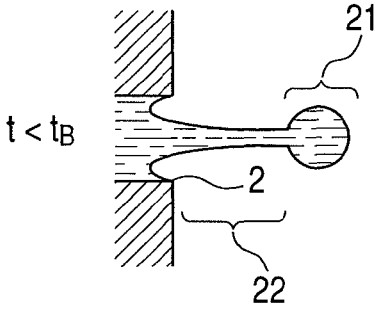
FIGS. 9A and 9B are views illustrating another liquid state immediately before and after the liquid droplet separation.
Figure 9B:
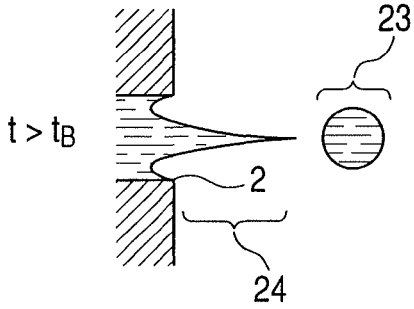

Additionally, immediately before and after the liquid droplet separation as shown in FIGS. 9A and 9B, the liquid at the edge of the discharge port, that is, the outer peripheral portion of the meniscus was concaved to the discharge port formation surface in some cases. However, even in this case, the liquid column 22 and the liquid column portion 24 substantially maintained the shape of which the thickness was gradually increased toward the discharge port 2. After the separation of the liquid droplet, the meniscus protruded and the protruding amount increased, thereby obtaining the same result described above.

In Japanese Patent Application Laid-Open No. 10-193587, FIG. 5 thereof shows a similar drawing to FIG. 8A in this specification. However, it is not described how the liquid droplet is formed or how the liquid column moves after the formation of the liquid droplet.

Figure 10:
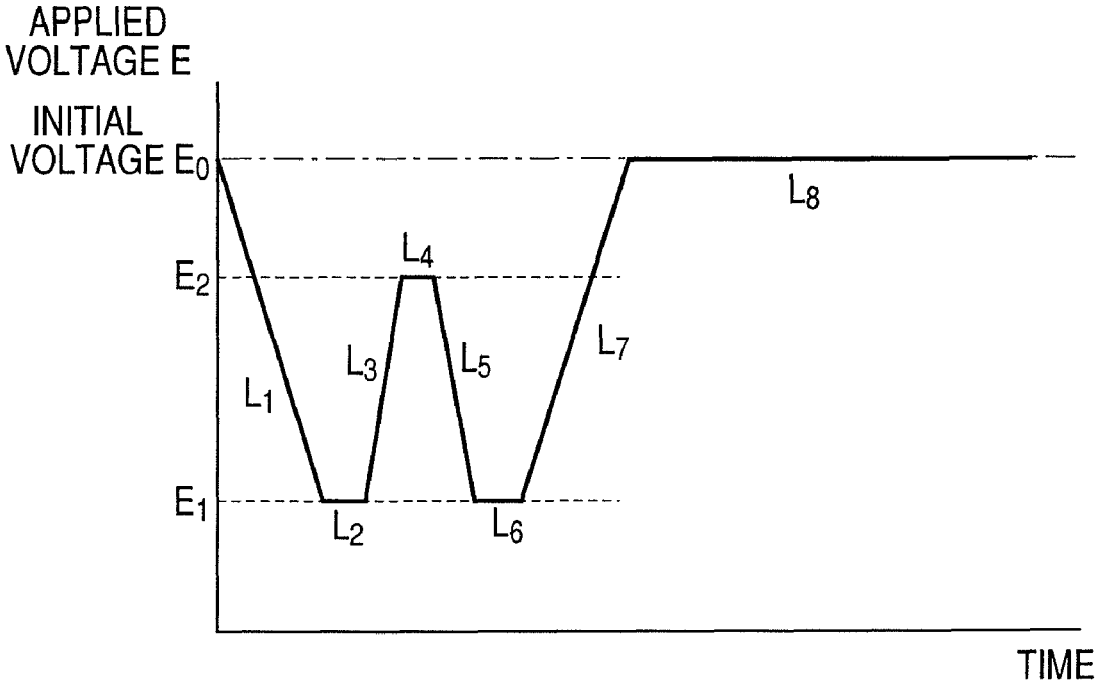
FIG. 10 is a view illustrating an example of a basic driving voltage waveform which is applied in order to obtain volume variation shown in FIG. 5.

FIG. 10 illustrates a driving voltage waveform which is applied in order to obtain volume variation shown in FIG. 5 and a movement of a discharge liquid shown in FIG. 7. As shown in the waveform, the volume of the individual liquid chamber is increased and decreased, and increased and decreased again to eject the liquid droplet. Basically, the waveform includes the following regions: a waveform region $L_1$ where an initial voltage $E_0$ varies to a first voltage $E_1$ to increase the volume of the individual liquid chamber, a waveform region $L_2$ where the first voltage $E_1$ is maintained, a waveform region $L_3$ where the first voltage $E_1$ varies to a second voltage $E_2$ to decrease the increased volume of the individual liquid chamber, a waveform region $L_4$ where the second voltage $E_2$ is maintained, a waveform region $L_5$ where the second voltage $E_2$ varies to the first voltage $E_1$ to increase the volume of the individual liquid chamber, a waveform region $L_6$ where the first voltage $E_1$ is maintained, a waveform region $L_7$ where the first voltage $E_1$ varies to the initial voltage $E_0$ to return the volume of the individual liquid chamber to the initial volume, and a waveform region $L_8$ where the initial voltage $E_0$ is maintained.

Additionally, the voltage level of the waveform region $L_2$ may be different from that of the waveform region $L_6$. Alternatively, the voltage level of the waveform region $L_4$ may be the same as that of the waveform region $L_8$, or the voltage level of the waveform region $L_4$ may be larger than that of the waveform region $L_8$.

In the example, a high potential of 33 V was maintained as an initial potential state, and then the potential was decreased to 0 V for 3 μs. Subsequently, the potential was maintained at 0 V for 5.5 μs, the potential was increased to 33 V for 1 μs, and then the potential was maintained at 33 V for 1 μs. Subsequently, the potential was decreased to 0 V for 1 μs, the potential was maintained at 0 V for 2 μs, and then the potential was increased to 33 V for 9 μs to return to the initial potential state.

By inputting such a driving voltage waveform, a minute liquid droplet, that is, the main liquid droplet which has a smaller diameter than the equivalent circular diameter of the discharge port can be discharged. However, an important point is that the waveform is not previously set, but the driving voltage waveform is selected and set so that the time transition of the increases and decreases of the volume of the individual liquid chamber induces the movement of the liquid preventing the satellite from being generated.

In the example, the driving voltage waveform is used to prevent the satellite from being generated, but an important point is that the waveform is not previously set, but the driving voltage waveform is selected and set so that the time transition of the increases and decreases of the volume of the individual liquid chamber determines a general standard for preventing the satellite from being generated. That is, it is possible to appropriately determine the voltage, the gradient of each waveform, and the shape of the basic waveform shown in FIG. 10 in consideration of the desirable discharge performance and the desirable movement of the liquid.

3.2 Comparative Example 1

Next, Comparative Example 1 will be described by comparing with Example 1. The used liquid discharging head and liquid were the same as those in Example 1. Similarly to Example 1, the input voltage has the driving voltage waveform for discharging the liquid droplet by increasing and decreasing the volume of the individual liquid chamber, and by increasing and decreasing the volume thereof again. However, at this time, the voltage waveform shown in FIG. 10 was slightly modified in order not to increase the shape of the liquid column and the protruding amount of the meniscus shown in FIG. 7. That is, a high voltage of 33 V was maintained as an initial potential state, and the potential was decreased to 0 V for 3 μs. Subsequently, the potential was maintained at 0 V for 5.5 μs, the potential was increased to 33 V for 1 μs, and then the potential was maintained at 33 V for 1 μs. Subsequently, the potential was decreased to 0 V for 1 μs, the potential was maintained at 0 V for 4 μs, and then the potential was increased to 33 V for 3 μs to return to the initial potential state.

As a result, in the discharged liquid droplet, an amount of discharge liquid was 1.8 pl and a speed of discharge liquid was 6.9 m/s, and the satellite was observed. After the discharge, the meniscus 30 protruded to the discharge port for a while as shown in FIG. 6, and then returned to a substantially flat state, which was the initial state.

The reason why the satellite is generated in Comparative Example 1 will be studied based on the actual movement of the liquid.

FIGS. 11A to 11K are views illustrating a liquid discharging state in the process $P_4$, which illustrate a liquid state from the start time point (FIG. 11A illustrates a state after 18 μs from the start time point of the process $P_1$) of the process $P_4$ at every interval of 2 μs. The CCD camera and the strobe light in synchronization with an ink discharge were used to obtain the measurement results.

When the discharging state is specifically examined, the thinnest portion of the liquid column which was left after the separation of the liquid droplet (main liquid droplet) was not the portion from which the main liquid droplet was separated, but a portion which was connected to the meniscus protruding from the discharge port 2 (as shown by the arrow in FIG. 1E). That is, unlike Example 1, the shape was formed so that the thickness was not increased toward the discharge port 2. As a result, the left liquid column portion was separated from the portion connected to the meniscus protruding from the discharge port 2 (see FIG. 11F), and thus became the satellite (see FIGS. 11E to 11K).

Additionally, unlike Example 1, the protruding amount of the meniscus did not increase (as shown by an auxiliary line B in FIGS. 11E to 11K) continuously toward the outside of the discharge port from the time point of the liquid separation time $t=t_B$. Accordingly, it shows that a reverse flow of sucking the liquid to the individual liquid chamber is generated at this stage in that the protruding meniscus shown in FIGS. 11E to 11I gradually thinned. As a result, the liquid column was not absorbed to the meniscus, and thus became the satellite.

Since the liquid moved as described above, the separation of the liquid column portion 24 occurred, and thus the satellite was generated.

3.3 Comparative Example 2

Next, Comparative Example 2 will be described by comparing with Example 1. At this time, the liquid discharging head in Example 1 was manufactured just by changing the thickness of the diaphragm to 3 μm. Other conditions and input voltage waveform are the same as those in Example 1.

As expected, the liquid discharging mode was different from that of Example 1, and thereby the satellite was generated. From the above fact, we confirmed that it is difficult to obtain a direct and general condition or causation for preventing the satellite from being generated just by considering the shape of the driving voltage waveform. Accordingly, the direct and general condition for preventing the satellite from being generated needs to meet the conditions described in Example 1 by considering the movement of the liquid droplet, the liquid column, and the protruding meniscus using the diaphragm.

4. Others

The embodiment and example describe the liquid discharging head for increasing or decreasing the volume of the individual liquid chamber according to the displacement of the diaphragm fixed to the piezoelectric element in the direction perpendicular to the surface thereof using the deformation of the piezoelectric element as the actuator.

However, in the invention, as long as the liquid discharge can be performed using an increase or decrease in the volume of the individual liquid chamber, a unit (volume control means) for inducing a displacement or deformation which serves as motive power is not limited to the piezoelectric element. For example, the invention may be applicable to a unit for increasing or decreasing the volume of the individual liquid chamber using the action of an electromagnetic force.

Additionally, the above described the case where the invention is applied to the ink jet recording apparatus which is an example of the liquid discharging apparatus and the liquid discharging head, but the invention may be applicable to not only the recording apparatus, but also a patterning apparatus, a coating apparatus, or other various liquid discharging apparatuses. That is, in the apparatus using liquid of various properties or various head structures, the satellite can be effectively prevented from being generated in any case by the general and appropriate guide line for the drive control of the liquid discharging head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-004440, filed Jan. 12, 2007, which is incorporated hereinto by its reference.

What is claimed is:

1. A liquid discharging method of discharging liquid as a liquid droplet from a discharge port by increasing or decreasing a volume of a liquid chamber communicating with the discharge port, the method comprising:

separating a substantially spherical liquid portion connected to a front end of a portion of the liquid extending in a column shape from the discharge port, from the front end, to form the liquid droplet, the portion of the liquid extending in the column shape being gradually thickened toward the discharge port immediately after the separation; and maintaining the portion of the liquid extending in the column shape so as not to be separated at any position of the portion of the liquid extending in the column shape; and retracting the portion of the liquid extending in the column shape into the discharge port by protruding a protruding portion of the liquid to an outside from the discharge port.

2. The liquid discharging method according to claim 1, wherein during the retracting, the volume of the protruding portion of the liquid protruding to the outside from the discharge port increases.

3. A liquid discharging apparatus comprising:

a liquid discharging head which has a discharge port for discharging a liquid, a liquid chamber communicating with the discharge port, and volume control means for increasing or decreasing the volume of the liquid chamber; and drive means which drives the volume control means, wherein the drive means drives the volume control means so as to separate a substantially spherical liquid portion, connected to a front end of a portion of the liquid extending in a column shape from the discharge port, from the front end, to form a liquid droplet, the portion of the liquid extending in the column shape being gradually thickened toward the discharge port immediately after the separation, to maintain the portion of the liquid extending in the column shape so as not to be separated at any position of the portion of the liquid extending in the column shape, and to retract the portion of the liquid extending in the column shape into the discharge port by protruding a protruding portion of the liquid to an outside from the discharge port.

* * * * *